US007377328B2

(12) United States Patent
Dewey et al.

(10) Patent No.: US 7,377,328 B2
(45) Date of Patent: May 27, 2008

(54) EXPANDABLE ANCHOR

(75) Inventors: Charles H. Dewey, Houston, TX (US); Brian W. Cruickshank, The Woodlands, TX (US); John E. Campbell, Houston, TX (US)

(73) Assignee: Smith International, Inc., Houston, TX (US)

( * ) Notice: Subject to any disclaimer, the term of this patent is extended or adjusted under 35 U.S.C. 154(b) by 279 days.

(21) Appl. No.: 11/069,282

(22) Filed: Mar. 1, 2005

(65) Prior Publication Data

US 2005/0194151 A1 Sep. 8, 2005

Related U.S. Application Data

(60) Provisional application No. 60/549,434, filed on Mar. 2, 2004.

(51) Int. Cl.
*E21B 7/08* (2006.01)

(52) U.S. Cl. ..... 166/387; 166/134

(58) Field of Classification Search ..... 166/313, 166/117.6, 118, 120, 134, 387
See application file for complete search history.

(56) References Cited

U.S. PATENT DOCUMENTS

| | | | | |
|---|---|---|---|---|
| 1,835,227 | A | 12/1931 | Lane et al. | |
| 3,397,746 | A | 8/1968 | Link | |
| 3,741,304 | A | 6/1973 | McGill | |
| 4,397,355 | A | 8/1983 | McLamore | |
| 4,712,614 | A | 12/1987 | Allwin et al. | |
| 4,848,462 | A | 7/1989 | Allwin | |
| 5,318,131 | A | 6/1994 | Baker | |
| 5,678,635 | A | 10/1997 | Dunlap et al. | |
| 5,878,818 | A | 3/1999 | Hebert et al. | |
| 6,164,377 | A | 12/2000 | Roberts | |
| 6,564,871 | B1 * | 5/2003 | Roberts | 166/313 |
| 7,178,589 | B2 * | 2/2007 | Campbell et al. | 166/216 |
| 2004/0149430 | A1 | 8/2004 | Campbell et al. | |

FOREIGN PATENT DOCUMENTS

GB 0504193.4 6/2005

OTHER PUBLICATIONS

USPTO Office Action Dated Aug. 29, 2007 for U.S. Appl. No. 11/670,888.

* cited by examiner

*Primary Examiner*—William P Neuder
(74) *Attorney, Agent, or Firm*—Conley Rose, P.C.

(57) ABSTRACT

An expandable downhole anchoring tool positionable within a wellbore for use in cooperation with drilling equipment comprises a body including a plurality of angled channels formed into a wall thereof, and a plurality of moveable slips disposed in the same radial plane around the body, wherein the plurality of moveable slips are hydraulically translatable along the plurality of angled channels between a collapsed position and an expanded position. A method of setting an expandable anchor within a wellbore comprises running the anchor into the wellbore in a collapsed position, and expanding the anchor into gripping engagement with the wellbore, wherein the anchor is adapted to expand up to at least 1.5 times a collapsed diameter of the anchor.

37 Claims, 5 Drawing Sheets

EXPANDABLE ANCHOR

CROSS-REFERENCE TO RELATED APPLICATIONS

The present application claims the benefit under 35 U.S.C. § 119(e) of U.S. Provisional Application Ser. No. 60/549,434 filed Mar. 2, 2004 and entitled "Expandable Down Hole Anchor", and further, the present application is related to U.S. application Ser. No. 10/719,199, filed Nov. 21, 2003, and entitled "Thru Tubing Tool and Method, now U.S. Patent Publication No. 2004/0149430, both hereby incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates generally to expandable anchoring tools for use in drilling operations, and methods of attaching an expandable anchor to a wellbore wall. Further, the present invention relates to methods and apparatus for drilling a secondary borehole from an existing borehole in geologic formations. More particularly, the present invention relates to expandable anchors that can be run into boreholes of varying diameters and then expanded to set against either a cased or open hole to anchor another well tool for conducting downhole well operations.

BACKGROUND

Once a petroleum well has been drilled and cased, it is often necessary or desired to drill one or more additional wells that branch off, or deviate, from the first well. Such multilateral wells are typically directed toward different parts of the surrounding formation, with the intent of increasing the output of the well. The main well bore can be vertical, angled or horizontal. Multilateral technology can be applied to both new and existing wells.

In order to drill a new borehole that extends outside an existing cased wellbore, the usual practice is to use a work string to run and set a whipstock via an anchor disposed at the lower end thereof. The upper end of the whipstock comprises an inclined face. The inclined face is designed to guide a window milling bit radially outwardly with respect to the casing axis as the milling bit is lowered, so that the milling bit engages and cuts a window in the casing. The lower end of the whipstock is adapted to engage an anchor in a locking manner that prevents both axial and rotational movement.

Multilateral technology provides operators several benefits and economic advantages. For example, multilateral technology can allow isolated pockets of hydrocarbons, which might otherwise be left in the ground, to be tapped. In addition, multilateral technology allows the improvement of reservoir drainage, increasing the volume of recoverable reserves and enhancing the economics of marginal pay zones. By utilizing multilateral technology, multiple reservoirs can be drained simultaneously. Thin production intervals that might be uneconomical to produce alone become economical when produced together with multilateral technology. Multiple completions from one well bore also facilitate heavy oil drainage.

In addition to production cost savings, development costs also decrease through the use of existing infrastructure such as surface equipment and the well bore. Multilateral technology expands platform capabilities where slots are limited and eliminates spacing problems by allowing more drain holes to be added within a reservoir. In addition, by sidetracking damaged formations or completions, the life of existing wells can be extended. Laterals may be drilled below a problem area once casing has been set, thereby reducing the risk of drilling through troubled zones. Finally, multilateral completions accommodate more wells with fewer footprints, making them ideal for environmentally sensitive or challenging areas.

Often however, a well bore is configured such that a tubular string of a smaller diameter is contained within a larger pipe string, casing, or open hole, thereby making it necessary to run well tools through the smaller diameter tubular and thereafter perform downhole operations (such as sidetracking) within the larger area provide by the larger pipe string, casing, or open hole. Expandable tools are generally used for such operations. Disadvantages of known expandable anchors include limited radial expansion capabilities and limited capability of securing the anchor within the larger diameter. As such, prior expandable anchors that support whipstocks for drilling sidetrack boreholes, for example, may be susceptible to small but not insignificant amounts of movement. Hence, it would be desirable to provide an expandable anchor that effectively prevents an anchored whipstock from moving.

SUMMARY

The present invention is directed to an expandable downhole anchoring tool positionable within a wellbore for use in cooperation with drilling equipment. In one embodiment, the expandable downhole anchoring tool comprises a body including a plurality of angled channels formed into a wall thereof, and a plurality of moveable slips disposed in the same radial plane around the body, wherein the plurality of moveable slips are hydraulically translatable along the plurality of angled channels between a collapsed position and an expanded position.

In another embodiment, the expandable downhole anchoring tool comprises a mandrel, a pair of movable slip housings each having a plurality of angled channels, and a plurality of slips disposed in the same radial plane about the mandrel that translate along the angled channels between a collapsed position and an expanded position, wherein the plurality of slips are disposed between the pair of moveable slip housings in the collapsed position.

In another aspect, the present invention is directed to a method of setting an expandable anchor within a wellbore comprising running the anchor into the wellbore in a collapsed position, and expanding the anchor into gripping engagement with the wellbore, wherein the anchor is adapted to expand up to at least 1.5 times a collapsed diameter of the anchor.

Other aspects and advantages of the invention will be apparent from the following description and the appended claims. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the present invention, reference will now be made to the accompanying drawings, wherein.

NOTATION AND NOMENCLATURE

Figure 1:
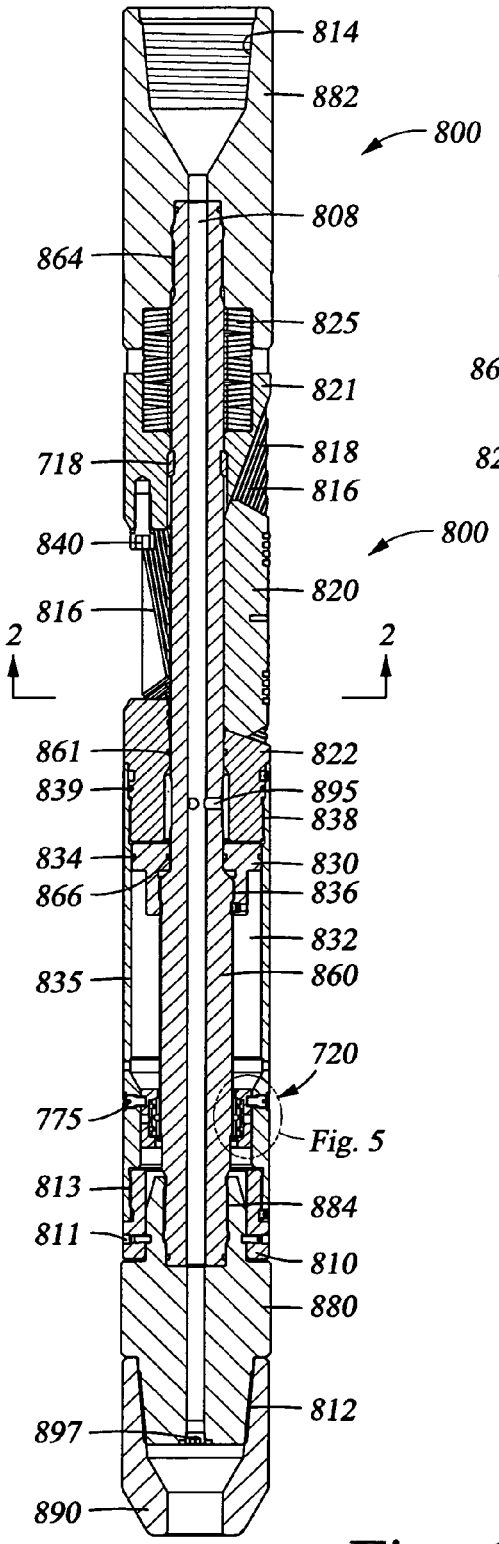
FIG. 1 is a cross-sectional side view of one embodiment of the expandable anchor in a locked and collapsed run-in position.

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up or down will be made for purposes of description with "up", "upper", or "upstream" meaning toward the earth's surface or toward the entrance of a well bore; and with "down", "lower", or "downstream" meaning toward the bottom of the well bore.

In the drawings, the cross-sectional side views of the expandable anchor should be viewed from top to bottom, with the upstream end at the top of the drawing and the downstream end at the bottom of the drawing.

DETAILED DESCRIPTION

Various embodiments of the expandable anchor and methods of use will now be described with reference to the accompanying drawings, wherein like reference numerals are used for like features throughout the several views.

FIGS. 1-8 depict one embodiment of an expandable anchor, generally designated as 800, in various operational positions. In an embodiment, the expandable anchoring tool 800 may be used, for example, in combination with a whipstock and drilling assembly for sidetracking operations, perhaps below a restriction. It should be appreciated, however, that the expandable anchor 800 may be used in many different types of drilling assemblies. Sidetracking and milling systems provide only some of the representative assemblies within which the expandable anchor 800 may be used, but these should not be considered the only assemblies. In particular, the expandable anchor 800 may be used in any drilling assembly requiring an anchoring tool. Further, it is to be fully recognized that the different teachings of the embodiments disclosed herein may be employed separately or in any suitable combination to produce desired results.

Figure 4:
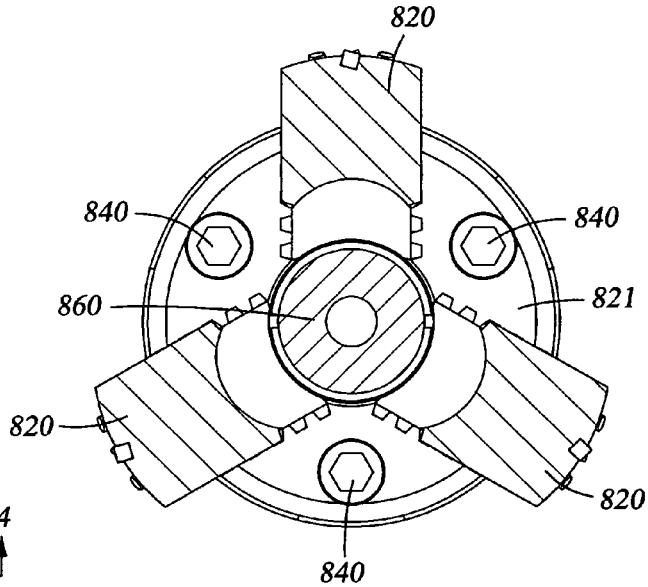
FIG. 4 is a cross-sectional end view taken at plane 4-4 of FIG. 3.
Figure 5:
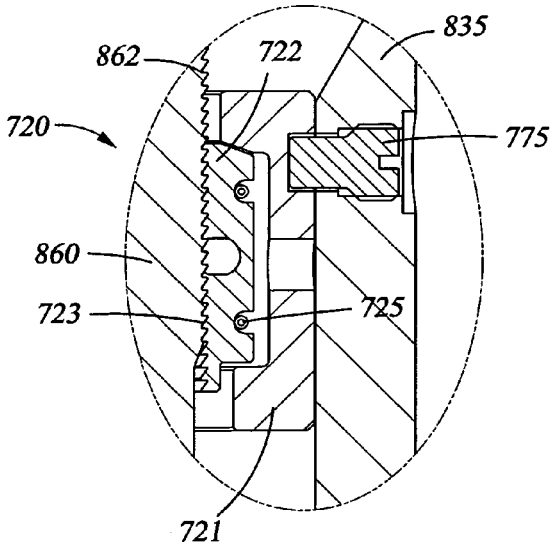
FIG. 5 is an enlarged cross-sectional view of one embodiment of a locking means of the expandable anchor of FIG. 1.
Figure 6:
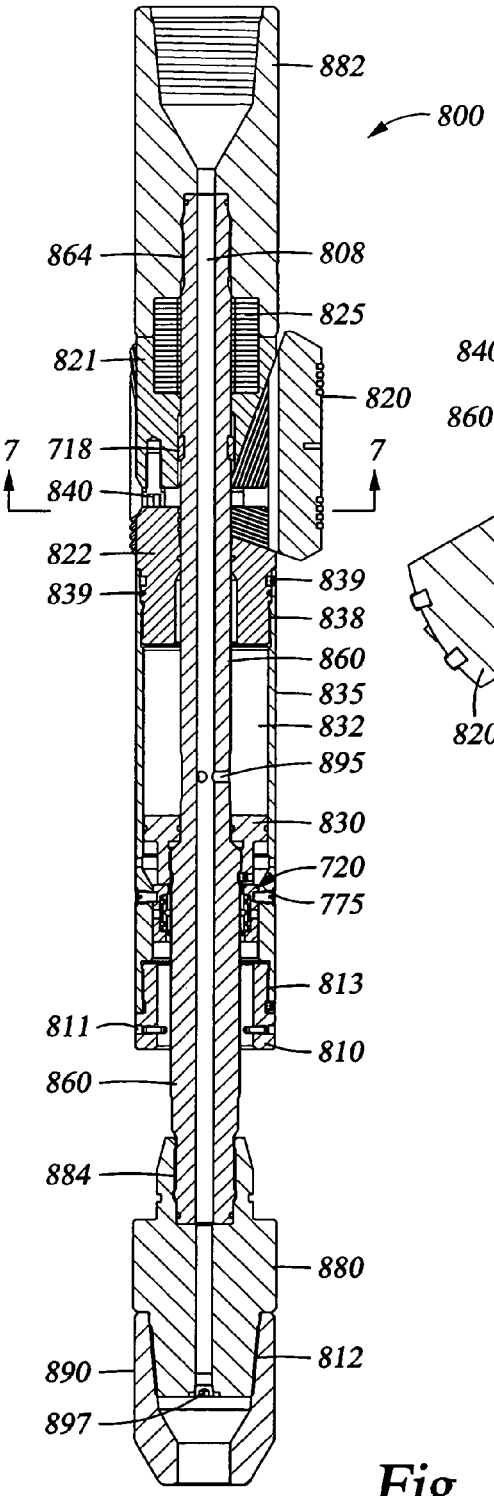
FIG. 6 is a cross-sectional side view of the expandable anchor of FIG. 1 with the slips in a maximum expanded position.
Figure 7:
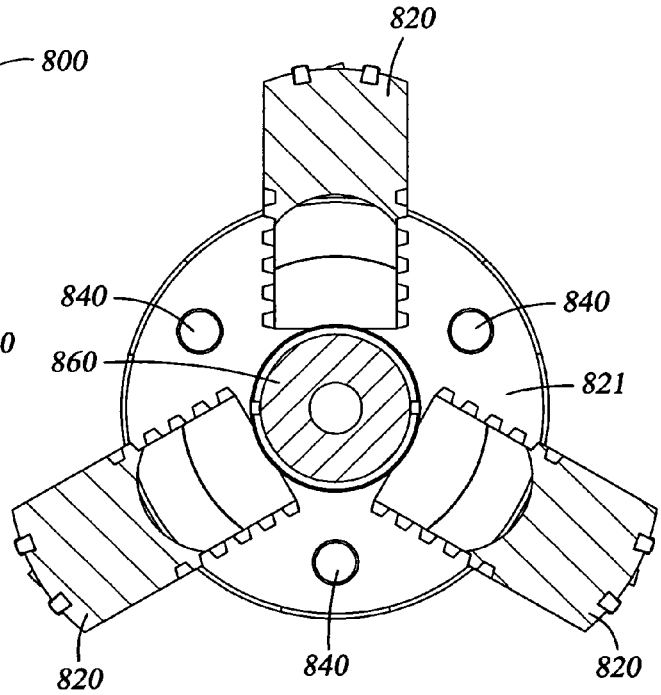
FIG. 7 is a cross-section end view taken at plane 7-7 of FIG. 6.
Figure 8:
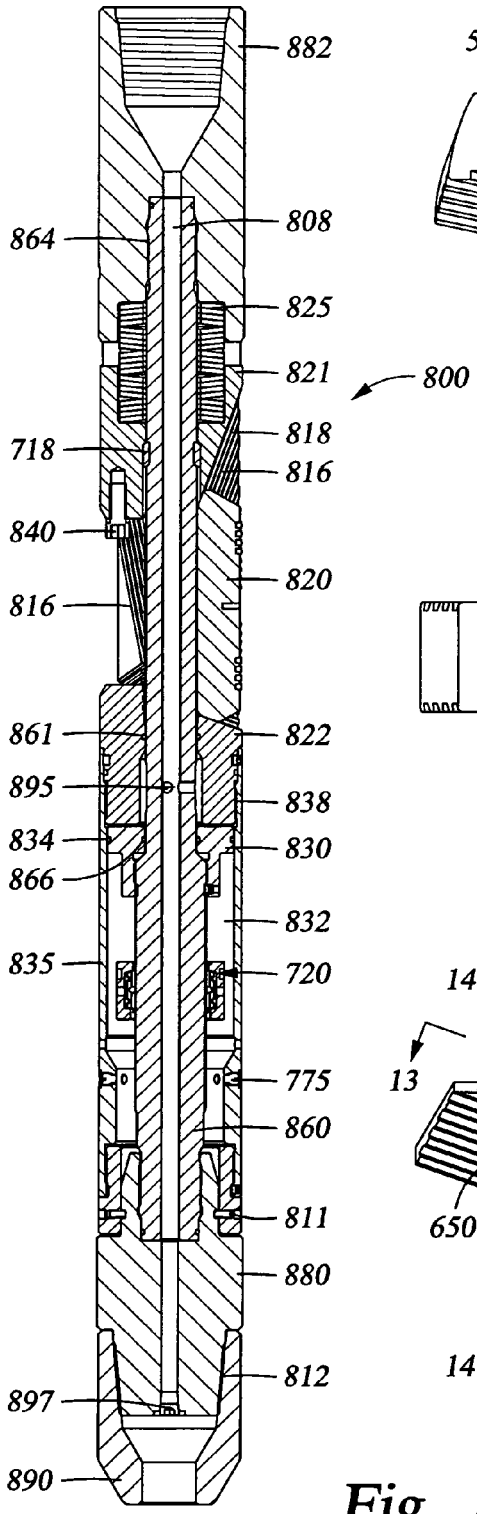
FIG. 8 is a cross-sectional side view of the expandable anchor of FIG. 1 in a released and collapsed position.
Figure 9:
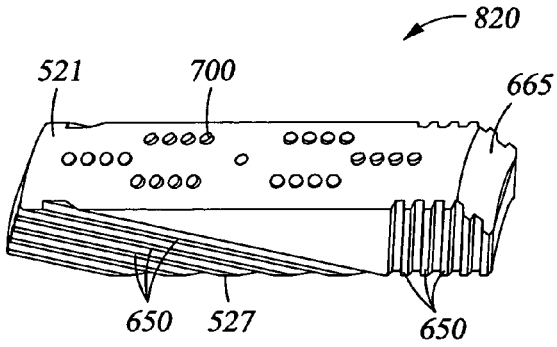
FIG. 9 is a perspective view of an individual slip of the expandable anchoring tool of FIG. 1.
Figure 10:
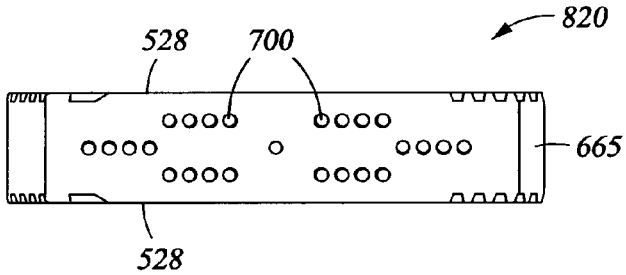
FIG. 10 is a front view of the slip of FIG. 9, depicting the borehole engaging surface.
Figure 11:
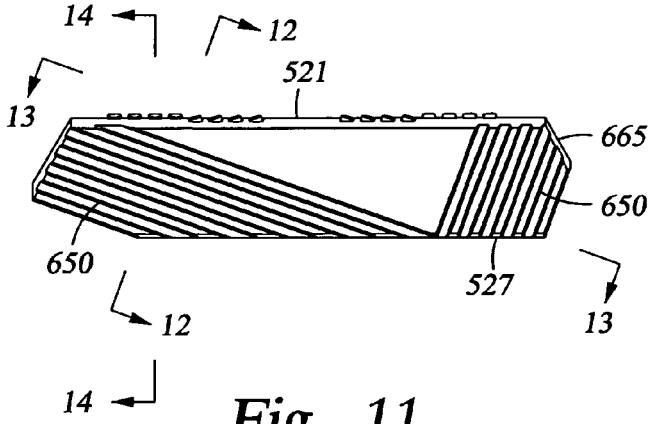
FIG. 11 is a side view of the slip of FIG. 9.

FIGS. 1-8 provide an operational overview of the expandable anchor 800. In particular, the expandable anchor 800 is lowered into the casing in the locked and collapsed position shown in FIGS. 1 and 2. When the expandable anchor 800 reaches a desired depth, the anchor 800 is unlocked and expanded to a set position shown in FIGS. 3 and 4 where the slips 820 of the anchor 800 engage a surrounding casing or open borehole wall. The expandable anchor 800 is configured to expand over a range of diameters, and FIGS. 6 and 7 depict the expandable anchor 800 in its maximum expanded position. Finally, to remove the expandable anchor 800 from the well, the anchor 800 is released from the casing to return to an unlocked and collapsed position as shown in FIG. 8.

Referring now to FIGS. 1-5, the expandable anchor 800 comprises a top sub 882 connected via threads 864 to a generally cylindrical mandrel 860 having a flowbore 808 therethrough, which in turn is connected via threads 884 to a nose 880. In one embodiment, the anchor 800 includes an upper box connection 814 and a lower pin connection 812 for connecting the anchor 800 into a downhole assembly. The upper box connection 814 may be connected to the lower end of a whipstock, for example. If the expandable anchor 800 is the lowermost tool in the downhole assembly, an optional nose protector 890 may be connected to the nose 880 at the lower pin connection 812. In such an assembly, a pipe plug 897 is connected to the nose 880 to close off the flowbore 808 of the mandrel 860 so that the anchor 800 may be expanded hydraulically.

The mandrel 860 is the innermost component within the anchor 800. Disposed around and slidingly engaging the mandrel 860 are a Belleville spring stack 825, an upper slip housing 821, one or more slips 820, and a lower slip housing 822. One or more recesses 816 are formed in the slip housings 821, 822 to accommodate the radial movement of the one or more slips 820. The recesses 816 include angled channels 818 formed into the wall thereof, and these channels 818 provide a drive mechanism for the slips 820 to move radially outwardly into the expanded positions depicted in FIGS. 3, 4, 6 and 7. In one embodiment, the expandable anchor 800 comprises three slips 820 as best shown in FIG. 4, wherein the three slips 820 are spaced 120° circumferentially in the same radial plane. It should be appreciated, however, that any number of slips 820 may be disposed in the same radial plane around the anchor 800. For example, the anchor 800 may comprise four slips 820, each approximately 90° from each other, or two slips 820, each approximately 180° from each other.

Referring again to FIGS. 1-5, connected via threads 838 to the lower slip housing 822 is a piston housing 835, which in turn is connected via threads 813 to a shear sub 810 that is releasably coupled to the nose 880 via one or more shear screws 811. The piston housing 835 forms a fluid chamber 832 around the mandrel 860 within which a piston 830 and a locking means 720 are disposed. The piston 830 connects via threads 836 to the mandrel 860, and the mandrel 860 includes ports 895 that enable fluid flow from the flowbore 808 into the fluid chamber 832 to actuate the anchor 800 to the expanded positions shown in FIGS. 3, 4, 6 and 7. In one embodiment, a seal 866 is provided between the piston 830 and the mandrel 860, a seal 834 is provided between the piston 830 and the piston housing 835 and a seal 839 is provided between the piston housing 835 and the lower slip housing 822.

FIG. 5 depicts an enlarged view of the locking means 720, shown releasably coupled to the piston housing 835 via one or more shear screws 775. The locking means 720 comprises a lock housing 721 mounted about the mandrel 860 and a lock nut 722, which interacts with the mandrel 860 to prevent release of the expandable anchor 800 when pressure is released. The outer radial surface of mandrel 860 includes serrations 862 which cooperate with inverse serrations 723 formed on the inner surface of locking nut 722, as described in more detail below.

FIGS. 9-16 depict various views of a single slip 820 of the expandable anchor 800. The slip 820 is shown in isometric view in FIG. 9, in front view in FIG. 10, and in side view in FIG. 11 to depict a front surface 521, a back surface 527, a top surface 665, a bottom surface 660, and two side surfaces 528. Top surface 665 and bottom surface 660 are preferably angled to assist in returning the slip 820 from an expanded position to a collapsed position. The slip 820 also includes extensions 650 disposed along each side 528 of slip 820. The extensions 650 preferably extend upwardly at an angle from the back surface 527 of the slip 820 toward the front, borehole engaging surface 521 of the slip 820. The extensions 650 protrude outwardly from the slip 820 to fit within corresponding channels 818 in the recesses 816 of the slip housings 821, 822. The interconnection between the slip extensions 650 and the body channels 818 increases the surface area of contact between the slips 820 and the slip housings 821, 822, thereby providing a more robust expandable anchor 800 as compared to prior art tools.

The front borehole engaging surface 521 may comprise, in one embodiment, a multiplicity of radially aligned engagement "threads" and axially aligned "fins" (not shown) that are designed, when the anchor 800 is in the expanded position, to grip the casing or open borehole wall and thereby resist torsional as well as axial loads imposed on the anchor 800 during sidetracking operations. In the embodiment depicted in FIGS. 9-16, buttons 700 may be set in the front surface 521 to grippingly engage the casing or open hole wall. In one embodiment, the material for the gripping buttons 700 is tungsten carbide.

Figure 12:
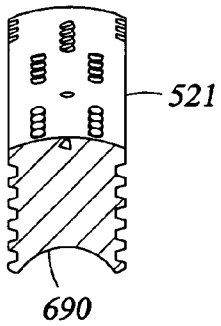
FIG. 12 is a cross sectional view taken at plant 12-12 of FIG. 11.
Figure 13:
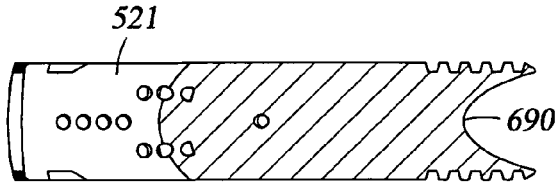
FIG. 13 is a cross sectional view taken at plant 13-13 of FIG. 11.
Figure 15:
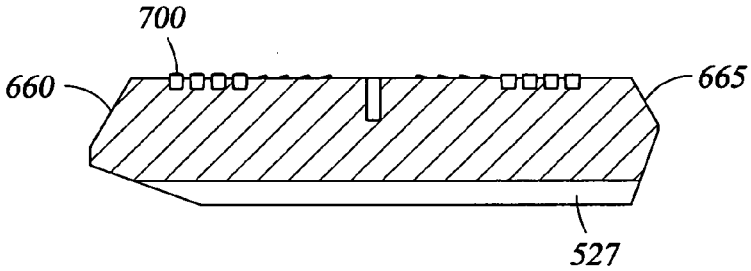
FIG. 15 is a cross sectional view taken at plant 15-15 of FIG. 14.
Figure 14:
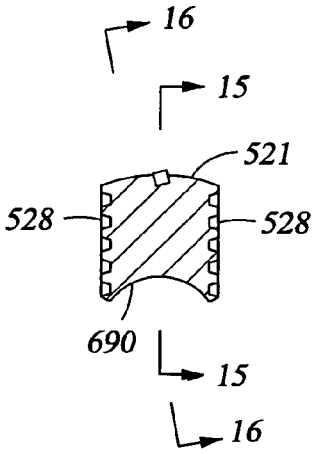
FIG. 14 is a cross sectional view taken at plant 14-14 of FIG. 11.
Figure 16:
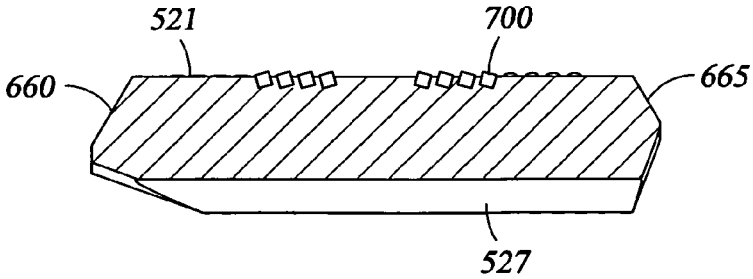
FIG. 16 is a cross sectional view taken at plant 16-16 of FIG. 14.

FIGS. 12 and 14 show a cavity 690 in the back surface 527 of the slip 820, which engages the mandrel 860. The cavity 690 extends for the full length of the slip 820 and can be of any desired configuration so long as it conforms to a substantial portion of the circumference of the mandrel 860. If the mandrel 860 is curvilinear, then the cavity 690 will be of conforming curvilinearity so that the mandrel 860 matingly engages the cavity 690. For example, if the mandrel 860 is essentially round, then the cavity 690 will be essentially hemi-circular as shown in FIGS. 12 and 14.

Figure 2:
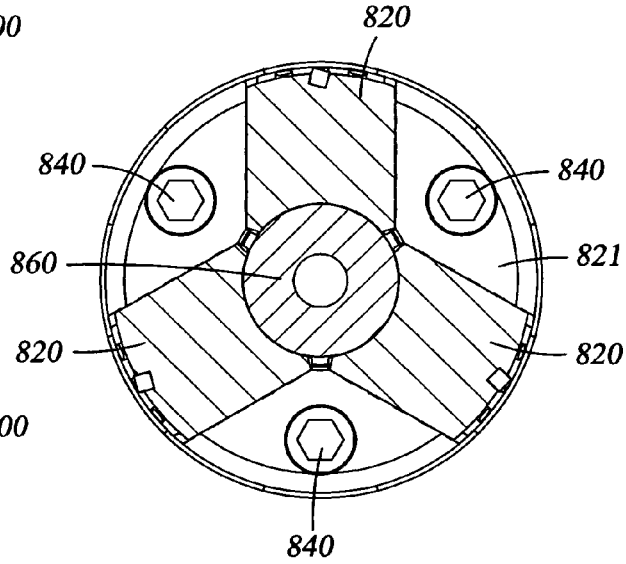
FIG. 2 is a cross-sectional end view taken at plane 2-2 of FIG. 1.
Figure 3:
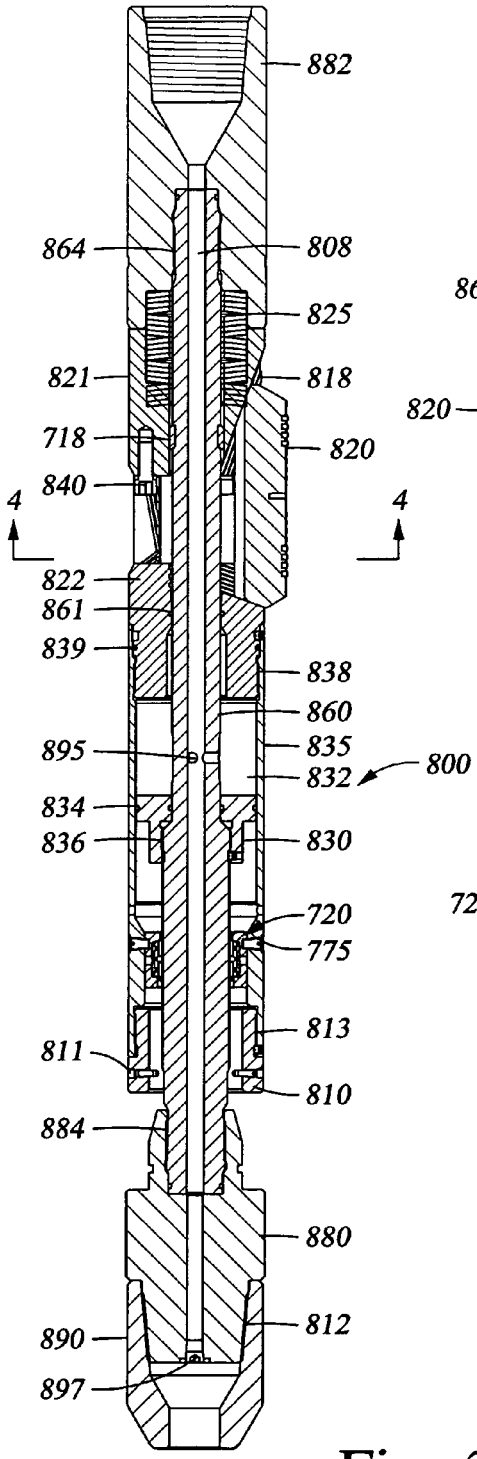
FIG. 3 is a cross-sectional side view of the expandable anchor of FIG. 1 in an unlocked and expanded position wherein the slips engage a surrounding wellbore wall.

Referring now to FIGS. 3 and 4, the expandable anchor 800 is depicted with the slips 820 in the expanded position, extending radially outwardly into gripping engagement with a surrounding casing or open borehole wall. The anchor 800 has two operational positions within a particular wellbore—namely a collapsed position as shown in FIGS. 1 and 2 for running the anchor into a wellbore, and an expanded position as shown in FIGS. 3 and 4 for grippingly engaging a wellbore.

To actuate the anchor 800, hydraulic forces are applied to cause the slips 820 to expand radially outwardly from the locked and collapsed position of FIGS. 1 and 2 to the unlocked and expanded position of FIGS. 3 and 4. Specifically, fluid flows down the flowbore 808 and through the ports 895 in the mandrel 860 into the chamber 832 surrounded by the piston housing 835. When the anchor 800 is the lowermost tool in a drilling assembly, a pipe plug 897 is provide to close off the flowbore 808 through the mandrel 860 to allow fluid pressure to build up within the anchor 800 to actuate it, i.e. expand the anchor 800. If, however, another tool is run below the anchor 800, pipe plug 897 is removed so that hydraulic fluid can flow through the anchor 800 to the lower tool. In such an operation, the lower tool includes a similar pipe plug within its bore so that hydraulic pressure can be built up in both the lower tool and the anchor 800 to actuate both tools. In an embodiment, one example of a lower tool that may be run below the anchor 800 is a hydraulically set well reference member described in U.S. Pat. No. 6,543,536 assigned to Smith International, Inc. The well reference member is set first in the wellbore, and then the expandable anchor 800 is set so that drilling through the casing can commence to produce a sidetracked well. Then the anchor 800 and the drilling assembly components connected above the anchor 800 are removed from the well, but the well reference member remains in the wellbore adjacent the window cut in the casing. As such, the well reference member provides a marker for future operations so that a drilling assembly can be lowered and connected to the well reference member in the proper orientation and at the right depth in the wellbore.

Referring again to FIGS. 1-5, pressure will continue to build in the fluid chamber 832 as the piston 830 provides a seal therein until the pressure is sufficient to cause shear screws 811 to shear. Since the piston 830 is connected via threads 836 to the mandrel 860, the piston 830 will remain stationary while the outer piston housing 835 and the lower slip housing 822 connected thereto will move axially upwardly from the position shown in FIG. 1 to the position shown in FIG. 3. Upward movement of the lower slip housing 822 acts against the slips 820 to drive the slips 820 radially outwardly along the channels 818. This upward motion will also cause the slips 820 and the upper slip housing 821 to move axially upwardly against the force of the Belleville spring stack 825.

Because the outer piston housing 835 is moveable to expand the slips 820 rather than the piston 830, the anchor 800 design eliminates a redundant piston stroke found in conventional expandable tools, and the expandable anchor 800 maintains approximately the same axial length in the collapsed position of FIG. 1 and in the expanded position of FIG. 3. The expandable anchor 800 also has a shorter mandrel 860 as compared to other anchors, and the slips 820 are nearly unidirectional. Therefore, the Belleville spring stack 825 is provided as a means to store up energy. If the Belleville spring stack 825 were not present, the energy stored in the anchor 800 would be based on how much the mandrel 860 stretches as the slips 820 are set against a wellbore. Although the mandrel 860 is made of a hard metal, such as steel, it still stretches a small amount, acting as a very stiff spring. Therefore, in order to store up energy in the anchor 800, this spring effect must be weakened or unstiffened to some degree, such as by adding the Belleville spring stack 825. In so doing, the stroke length required to set the slips 820 is increased since the slips 820 have to move far enough to compress the Belleville spring stack 825. Thus, the Belleville spring stack 825 is provided to store up energy, which requires the anchor 800 to be stroked further to set it because the spring stack 825 must be fully compressed as shown in FIGS. 3 and 6.

Referring now to FIGS. 6 and 7, the anchor 800 is also configured for operation within wellbores having a range of diameters, and the anchor 800 is depicted in its maximum expanded position. In an embodiment, a spacer screw 840 is provided to maintain a space between the lower slip housing 822 and the upper slip housing 821 when the anchor 800 is in its maximum expanded position. During assembly of the anchor 800, when installing the slips 820, the upper slip housing 821 and the lower slip housing 822 are abutted against each other, and the extensions 650 in the slips 820 are aligned with the channels 818 in the recesses 816 of the slip housings 821, 822. Then the upper and lower slip housings 821, 822 are pulled apart and the slips 820 collapse into the anchor 800 around the mandrel 860. To ensure that the anchor 800 does not overstroke downhole, the spacer screw 840 stops the upper and lower slip housing 821, 822 from abutting together as during assembly, thereby preventing the slips 820 from falling out of the anchor 800. Thus, in the maximum expanded position, the spacer screw 840 provides a stop surface against which the lower slip housing 822 is prevented from further upward movement so that it remains spaced apart from the upper slip housing 821. The spacer screw 840 is provided only as a safety mechanism because the slips 820 should engage the wellbore wall in an intermediate expanded position, as shown in FIGS. 3 and 4, well before the lower slip housing 822 engages the spacer screw 840.

Thus, the expandable anchor 800 is fully operational over a wide range of diameters, and has an expanded position that varies depending on the diameter of the wellbore. As such, the expandable anchor 800 is specifically designed to provide proper anchoring of a drilling assembly to withstand compression, tension, and torque for a range of wellbore diameters. Specifically, the expandable anchor 800 is configured to expand up to at least 1.5 times the collapsed diameter of the anchor 800. For example, in one embodiment, the expandable anchor 800 has a collapsed diameter of approximately 8.19 inches and is designed to expand into engagement with 9⅝ inch casing up to 13⅜ inch casing, which correlates with an 8½ inch diameter wellbore up to a 12¼ inch diameter wellbore.

Referring again to FIG. 5, once the slips 820 are expanded into gripping engagement with a borehole, to prevent the anchor 800 from returning to a collapsed position until so desired, the expandable anchor 800 is also provided with a locking means 720. As the piston housing 835 moves, so will a lock housing 721 that is connected thereto via shear screws 775 mounted about the mandrel 860. The lock housing 721 cooperates with a lock nut 722, which interacts with the mandrel 860 to prevent release of the anchor 800 when hydraulic fluid pressure is released. Specifically, the outer radial surface of mandrel 860 includes serrations 862, which cooperate with inverse serrations 723 formed on the inner surface of the locking nut 722. Thus, as the piston housing 835 moves the lock housing 721 upwardly, the locking nut 722 also moves upwardly in conjunction therewith causing the inner serrations 723 of the locking nut 722 to move over the outer serrations 862 of the mandrel 860. The serrations 862 on the mandrel 860 are one-way serrations 862 that only allow the locking nut 722 and the components that are connected thereto to move upstream when hydraulic pressure is applied to the anchor 800. Therefore, because of the ramped shape of the serrations 862, the locking nut 722 can only move in one direction, namely upstream, with respect to the mandrel 860. The interacting serrations 723, 862 prevent movement in the downstream direction since there is no ramp on the mandrel serrations 862 that angle in that direction. Thus, interacting edges of the serrations 723, 862 ensure that movement will only be in one direction, thereby preventing the anchor 800 from returning to a collapsed position until so desired.

Still referring to FIG. 5, in an embodiment, the locking nut 722 is machined as a hoop and then split into multiple segments, and a garter spring 725 is provided to hold the segments of the locking nut 722 around the mandrel 860. The garter spring 725 resembles an O-ring, except that the spring 725 is made out of wire. The wire is looped around the locking nut 722, and the ends are hooked together. The garter spring 725 allows the sections of the locking nut 722 to open and close as the locking nut 722 jumps over each individual serration 862 as it moves upwardly on the mandrel 860. Thus, the garter spring 725 allows the locking nut 722 to slide up the ramp of a mandrel serration 862 and jump over to the next serration 862, thereby ratcheting itself up the mandrel 860. The garter spring 725 also holds the locking nut 722 segments together so that the locking nut 722 cannot back up over the serrations 862 on the mandrel 860.

Referring now to FIG. 8, the expandable anchor 800 is also designed to return from an expanded position to a released, collapsed position. The anchor 800 can be released from gripping engagement with a surrounding borehole by applying an upward force sufficient to allow the slips 820 to retract to the released and collapsed position shown in FIG. 8. In particular, the lock housing 721 is connected to the piston housing 835 by shear screws 775. To return the anchor 800 to a collapsed position, an axial force is applied to the anchor 800 sufficient to shear the shear screws 775, thereby releasing the locking means 720. As shown in FIGS. 1, 3, 6 and 8, a release ring 718 is disposed between the upper slip housing 721 and the mandrel 860. In one aspect, the release ring 718 provides a shoulder to prevent the upper slip housing 821 from sliding too far downwardly with respect to the slips 820 in the run-in position of FIGS. 1 and 2, or after releasing the anchor 800 to the position shown in FIG. 8. In another aspect the release ring 718 is configured to allow the mandrel 860 to move a small distance axially before the slips 820 disengage from the wellbore to allow for the shear screws 775 to shear completely. Thus, when an axial force is applied to the mandrel 860, the release ring 718 allows for the slips 820 to maintain engagement with the wellbore to provide a counter force against which the shear screws 775 can shear. Therefore, the release ring 718 allows for the shear screws 775 to shear completely, which enables the slips 820 to collapse back into the anchor 800. With the anchor 800 in the released and collapsed position of FIG. 8, the anchor 800 can be removed from the wellbore.

In summary, the various embodiments of the expandable anchor 800 of the present invention may be used as an anchor to grippingly engage a larger diameter tubular or borehole, whether cased or open hole. The various embodiments of the present invention solve the problems of the prior art and include other features and advantages. Namely, the embodiments of the present expandable anchor 800 are stronger and more robust than prior art expandable anchoring tools.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention.

What is claimed is:

1. An expandable downhole anchoring tool positionable within a wellbore for use in cooperation with drilling equipment comprising:

a body including a plurality of angled channels formed into a wall thereof;

a plurality of moveable slips disposed in the same radial plane around said body, wherein said plurality of moveable slips are hydraulically translatable along said plurality of angled channels between a collapsed position and an expanded position; and a moveable outer housing having a fluid chamber such that when a fluid in said fluid chamber is pressurized, said outer housing moves to translate said plurality of slips from said collapsed position to said expanded position.

2. The tool of claim 1 wherein each of said plurality of slips comprises a plurality of extensions corresponding to and engaging said plurality of channels.

3. The tool of claim 2 wherein said extensions and said channels comprise a drive mechanism for moving said plurality of slips between said collapsed position and said expanded position.

4. The tool of claim 2 wherein said extensions and said channels support loading on said plurality of slips in said expanded position.

5. The tool of claim 1 wherein said plurality of slips comprises two, three or four slips spaced apart circumferentially in the same radial plane around said body.

6. The tool of claim 1 wherein each of said plurality of slips comprises angled surfaces for collapsing said slips into said body.

7. The tool of claim 1 wherein said plurality of slips are adapted to grippingly engage the wellbore in said expanded position.

8. The tool of claim 7 wherein at least one of said plurality of slips includes a carbide insert for grippingly engaging said wellbore in said expanded position.

9. The tool of claim 7 wherein at least one of said plurality of slips includes a plurality of threads for grippingly engaging said wellbore in said expanded position.

10. The tool of claim 7 wherein said plurality of slips are adapted to resist axial and torsional forces when grippingly engaging the wellbore in said expanded position.

11. The tool of claim 7 wherein said plurality of slips are adapted to expand to a range of diameters, and said expanded position is defined by the diameter of the wellbore.

12. The tool of claim 1 further comprising a locking means for preventing said plurality of slips from translating between said expanded position and said collapsed position.

13. The tool of claim 1 further comprising a releasing means for allowing said plurality of slips to translate between said expanded position and said collapsed position.

14. The tool of claim 1 further comprising a first tool diameter in said collapsed position and a second tool diameter in said expanded position; wherein said second tool diameter is up to at least 1.5 times said first tool diameter.

15. The tool of claim 1 further comprising a Belleville spring stack that stores energy in the tool.

16. An expandable downhole anchoring tool positionable within a wellbore for use in cooperation with drilling equipment comprising:

a mandrel;

a pair of moveable slip housings each having a plurality of angled channels; and a plurality of slips disposed in the same radial plane about said mandrel that translate along said angled channels between a collapsed position and an expanded position;

wherein said plurality of slips are disposed between said pair of moveable slip housings in said collapsed position.

17. The tool of claim 16 wherein each of said plurality of slips comprises a plurality of extensions corresponding to and engaging said plurality of channels.

18. The tool of claim 17 wherein said extensions and said channels comprise a drive mechanism for moving said plurality of slips between said collapsed position and said expanded position.

19. The tool of claim 17 wherein said extensions and said channels support loading on said plurality of slips in said expanded position.

20. The tool of claim 16 wherein said plurality of slips comprises two, three or four individual slips spaced apart circumferentially in the same radial plane about said mandrel.

21. The tool of claim 16 wherein said pair of movable slip housings translates said plurality of slips from said collapsed position to said expanded position.

22. The tool of claim 16 wherein each of said plurality of slips comprises a cavity for matingly engaging said mandrel while in said collapsed position.

23. The tool of claim 16 wherein said plurality of slips are adapted to grippingly engage the wellbore in said expanded position.

24. The tool of claim 23 wherein at least one of said plurality of slips includes a carbide insert for grippingly engaging said wellbore in said expanded position.

25. The tool of claim 23 wherein at least one of said plurality of slips includes a plurality of threads for grippingly engaging said wellbore in said expanded position.

26. The tool of claim 23 wherein said plurality of slips are adapted to resist axial and torsional forces when grippingly engaging the wellbore in said expanded position.

27. The tool of claim 23 wherein said plurality of slips are adapted to expand to a range of diameters, and said expanded position is defined by the diameter of the wellbore.

28. The tool of claim 16 further comprising a locking means for preventing said plurality of slips from translating between said expanded position and said collapsed position.

29. The tool of claim 16 further comprising a releasing means for allowing said plurality of slips to translate between said expanded position and said collapsed position.

30. The tool of claim 16 further comprising a first tool diameter in said collapsed position and a second tool diameter in said expanded position; wherein said second tool diameter is up to at least 1.5 times said first tool diameter.

31. The tool of claim 16 further comprising a Belleville spring stack that stores energy in the tool.

32. A method of setting an expandable anchor within a wellbore comprising:

running the anchor into the wellbore in a collapsed position;

moving a housing about a piston positioned therein to drive a plurality of slips; and expanding the anchor into gripping engagement with the wellbore;

wherein the anchor is adapted to expand up to at least 1.5 times a collapsed diameter of the anchor.

33. The method of claim 32 wherein expanding the anchor comprises flowing a fluid through the anchor.

34. The method of claim 32 further comprising locking the anchor into gripping engagement with the wellbore.

35. The method of claim 34 further comprising releasing the anchor to return the anchor to the collapsed position.

36. The method of claim 32 wherein expanding the anchor comprises driving a plurality of slips radially outwardly along a plurality of channels in a body of the anchor.

37. The method of claim 32 further comprising:

pressurizing a fluid in a fluid chamber of the moveable housing to move the housing about the piston; and receiving the plurality of slips with a moveable upper slip housing.

* * * * *